US009296519B2

(12) United States Patent
Suzuki et al.

(10) Patent No.: US 9,296,519 B2
(45) Date of Patent: Mar. 29, 2016

(54) RECYCLABILITY ENHANCEMENT OF FOOD CONTAINERS

(71) Applicants: Kiyan Suzuki, Irvine, CA (US); Shabnam Suzuki, Irvine, CA (US); Sana Suzuki, Irvine, CA (US); William David Bishop, Jr., Irvine, CA (US)

(72) Inventors: Kiyan Suzuki, Irvine, CA (US); Shabnam Suzuki, Irvine, CA (US); Sana Suzuki, Irvine, CA (US); William David Bishop, Jr., Irvine, CA (US)

( * ) Notice: Subject to any disclaimer, the term of this patent is extended or adjusted under 35 U.S.C. 154(b) by 279 days.

(21) Appl. No.: 13/666,396

(22) Filed: Nov. 1, 2012

(65) Prior Publication Data

US 2013/0118946 A1 May 16, 2013

Related U.S. Application Data

(60) Provisional application No. 61/554,394, filed on Nov. 1, 2011.

(51) Int. Cl.

| | |
|---|---|
| ***B65D 85/84*** | (2006.01) |
| ***B65D 25/14*** | (2006.01) |
| ***B65D 25/16*** | (2006.01) |
| ***B65D 33/28*** | (2006.01) |
| ***B65D 5/54*** | (2006.01) |
| ***B65D 5/56*** | (2006.01) |
| ***B65D 5/60*** | (2006.01) |

(52) U.S. Cl.

CPC ..... *B65D 25/14* (2013.01); *B65D 5/5445* (2013.01); *B65D 5/563* (2013.01); *B65D 5/603* (2013.01); *B65D 5/606* (2013.01); *B65D 25/16* (2013.01); *B65D 33/28* (2013.01)

(58) Field of Classification Search

CPC ..... B65D 25/14; B65D 25/16; B65D 33/28; B65D 5/606; A47G 19/02

USPC ..... 206/524.3, 204; 220/574.3, 495.06, 220/62.21, 495.01, 495.03, 23.9; 229/117.31–117.35, 117.3, 117.27, 229/117.28; 383/61.4, 72, 75

See application file for complete search history.

(56) References Cited

U.S. PATENT DOCUMENTS

| | | | | |
|---|---|---|---|---|
| 1,138,144 | A * | 5/1915 | Wright | 383/18 |
| 2,542,413 | A * | 2/1951 | Ibsch, Jr. | 220/574.3 |
| 2,588,727 | A * | 3/1952 | Howard | 220/574 |
| 2,599,708 | A | 6/1952 | Gottesman | |
| 3,459,357 | A | 8/1969 | Egger et al. | |
| 3,576,290 | A | 4/1971 | Marchisen | |
| 4,048,361 | A * | 9/1977 | Valyi | 215/12.2 |
| 4,093,114 | A * | 6/1978 | Lawes | 229/117.33 |
| 4,786,189 | A * | 11/1988 | Broderick et al. | 383/75 |
| 5,203,470 | A * | 4/1993 | Brown | 229/117.3 |

(Continued)

FOREIGN PATENT DOCUMENTS

| | | |
|---|---|---|
| FR | 2826937 | 1/2003 |
| FR | 2848189 | 6/2004 |

OTHER PUBLICATIONS

"Polyhydroxyalkanoates" *Wikipedia,* pp. 1-4, retrieved Oct. 16, 2012: en.wikipedia.org/wiki/Polyhydroxyalkanoate.

(Continued)

*Primary Examiner* — Chun Cheung

(74) *Attorney, Agent, or Firm* — Occhiuti & Rohlicek LLP

(57) ABSTRACT

A food container includes a first interior face having disposed thereon a first protective layer for protecting the first interior face from exposure to contaminants that would interfere with recycling of the food container. The first protective layer is affixed to the first interior face by an adhesive interface so as to be peelable from the first interior face.

35 Claims, 11 Drawing Sheets

(56) References Cited

U.S. PATENT DOCUMENTS

| | | | | |
|---|---|---|---|---|
| 5,506,036 | A | 4/1996 | Bergerioux | |
| 6,585,153 | B2 * | 7/2003 | Ryan | 229/117.32 |
| 6,676,011 | B2 * | 1/2004 | Luu et al. | 229/117.33 |
| 7,021,524 | B1 * | 4/2006 | Becker et al. | 229/117.35 |
| 7,487,902 | B2 * | 2/2009 | Philips et al. | 229/115 |
| 2005/0011778 | A1 * | 1/2005 | Thomas | 206/204 |
| 2010/0239191 | A1 * | 9/2010 | Chilton | 383/75 |
| 2011/0192890 | A1 * | 8/2011 | Chebli | 229/103.11 |
| 2012/0008880 | A1 * | 1/2012 | Toth | 383/42 |
| 2012/0102636 | A1 * | 5/2012 | West | 4/479 |

OTHER PUBLICATIONS

"Standard EN 13432: Proof of compostability of plastic products" *Biodegradable Products Institute,* pp. 1-2, retrieved Oct. 16, 2012: www.bpiworld.org/Default.aspx?pageId=190437.

"Polyhydroxybutyrate" *Wikipedia,* pp. 1-3, retrieved Oct. 16, 2012: en.wikipedia.org/wiki/Poly-3-hydroxybutyrate.

"Biodegradable Plastic Bags: Compostable and Biodegradable Bags" *Biodegradable Plastic Bags,* pp. 1-3, retrieved Oct. 16, 2012: www.biodegradableplasticbags.org.

"ASTM D6400—Test for Compostability" *Biodegradable Products Institute,* pp. 1-2, retrieved Oct. 16, 2012: www.bpiworld.org/Default.aspx?pageId=190422.

"D6868—Biodegradable Plastics" *Biodegradable Products Institute,* pp. 1-2, retrieved Oct. 16, 2012: www.bpiworld.org/Default.aspx?pageId=190424.

"The Myths of Biodegradation" *Biodegradable Products Institute,* pp. 1-2, retrieved Oct. 16, 2012: www.bpiworld.org/Default.aspx?pageId=190439.

"What is Glassine Paper?" *InnovateUs Inc.,* pp. 1-2, retrieved Oct. 16, 2012: www.innovateus.net/innopedia/what-glassine-paper.

"Pressure Sensitive Adhesives: a Sticky Recycling Problem" *California Department of Resources Recycling and Recovery,* p. 1, retrieved Oct. 16, 2012: www.calrecycle.ca.gov/ReduceWaste/Business/officepaper/PSAFacts.htm.

Dave Gilson "Do Biodegradable Plastics Really Work?" *Mother Jones,* pp. 1-8, (May/Jun. 2009) retrieved Oct. 16, 2012: www.motherjones.com/environment/2009/05/do-biodegradable-plastics-really-work.

"Glassine" *Wikipedia,* pp. 1-2, retrieved Oct. 16, 2012: en.wikipedia.org/wiki/Glassine.

* cited by examiner

RECYCLABILITY ENHANCEMENT OF FOOD CONTAINERS

RELATED APPLICATIONS

Under 35 USC 119, this application claims the benefit of the priority date of U.S. provisional application 61/554,394 filed on Nov. 1, 2011, and entitled "Improved Green and Recyclable Peelabox Containers," the contents of which are herein incorporated by reference.

FIELD OF INVENTION

This disclosure pertains to recycling, and in articular, to recycling of food containers.

BACKGROUND

Recycling cellulose-based materials, such as cardboard and paper, works best when the materials are reasonably clean. The process thus works well with office paper, newsprint, and shipping boxes.

A difficulty arises when such materials are contaminated with oil or grease.

Pizza boxes and take-out food containers are particular culprits. Proper recycling of these containers relies in part on proper curbside preparations. In the case of take-out food containers, proper washing with soap and hot water is required to remove grease. Pizza boxes cannot be washed, and must generally have the bottom portion torn off and discarded separately.

Another difficulty arises even with clean containers. Many food containers are coated with a material such as wax or plastic. For example, the traditional "Chinese Take-out Box," which was once called an "oyster pail," is a folded waxed or plastic-coated paperboard container with a solid wire handle. The paraffin-based wax or plastic coating on such containers hinders their recyclability.

SUMMARY

In one aspect, the invention features a manufacture including a food container. The food container includes a first interior face having disposed thereon a first protective layer for protecting the first interior face from exposure to contaminants that would interfere with recycling of the food container. The first protective layer is affixed to the first interior face by an adhesive interface so as to be peelable from the first interior face.

The protective layer offers numerous advantages, including protecting the surface of the container from contaminants, and in some cases increasing the shelf-life of the content of the container.

Embodiments include those in which the first protective layer comprises an oxide coating, such as silicon-dioxide, a metal oxide, for example aluminum oxide. Also included are embodiments in which the protective layer comprises a metal coating.

In some embodiments, the adhesive interface includes a recycling-compatible adhesive. Also included among the embodiments are those in which the adhesive interface includes a water-soluble adhesive, and those in which the adhesive interface includes a material selected to avoid interfering with re-pulping the food container.

Among the embodiments of the invention are those in which the adhesive interface is disposed along a periphery of the first face and wherein an interior area of the first face, which is bounded by the periphery, is free of adhesive. However, in other embodiments, the adhesive interface is disposed to cover the entire first face, thereby preventing slippage of the protective layer relative to the first face.

Embodiments of the invention includes those in which the first protective layer includes an oil-absorbent lamina and a non-stick lamina conjoined to the oil-absorbent lamina, wherein the oil-absorbent lamina is disposed to be exposed to food in the food container and the non-stick lamina is disposed to contact the adhesive. Among these embodiments are those in which the non-stick lamina includes glassine paper, those in which the non-stick lamina includes biodegradable plastic, those in which the non-stick lamina includes a lignin-based biodegradable plastic, those in which the non-stick lamina includes polyhydroxyalkanoate, those in which the non-stick lamina includes polyhydroxybuterate, and those in which the non-stick lamina includes polyurethane.

Some embodiments further include a tab affixed to the first protective layer for enabling application of a force to peel the first protective layer off the first interior face. Other embodiments include a channel formed in a periphery of the first protective layer, and a drawstring passing through the channel, the drawstring having a portion that, when pulled, peels the protective layer off the first interior face and forms the protective layer into a sack. Yet other embodiments include means for enabling application of a force for peeling the first protective layer off the first interior face.

Among the embodiments that include a drawstring and channel are those in which the channel formed in the periphery through which the drawstring passes includes a plurality of cutaways through which the drawstring is accessible. Some of these embodiments have tabs, either attached to an accessible section of drawstring, or moveable relative to the accessible section of the drawstring. Yet others feature a loop coupled to an accessible section of the drawstring.

In some embodiments, the food container includes a second interior face, the second interior face having a second protective layer disposed thereon for protecting the second interior face from exposure to contaminants that would interfere with recycling of the food container, the second protective layer being affixed to the second interior face by an adhesive interface so as to be peelable from the second interior face.

In other embodiments, the food container includes a second interior face, and wherein the first protective layer spans the first interior face and the second interior face.

Embodiments include those in which the food container includes, those in which it includes a cellulose-based material, those in which it includes corrugated cardboard, and those in which it include metal.

Also included among the embodiments are those in which the protective layer includes at most one lamina, as well as those in which the protective layer has more than two lamina.

In other embodiments, the container itself is made of recycled material, such as recycled cellulose-based material, or recycled plastic.

In some embodiments, the food container includes a second interior face, the second face having a second protective layer for protecting the second interior face from exposure to contaminants that would interfere with recycling of the food container, the second protective layer being affixed to the second interior face by an adhesive interface so as to be peelable from the second interior face.

A variety of different food containers can be used. These include, but are not limited to, a corrugated fiber box, a pizza box, a bucket, such as that used for transporting fried chicken and/or popcorn, a pastry box, a cake box, a take-out food container of the type commonly provided by restaurants to and customers who wish to take food home, for example an oyster pail or traditional Chinese take-out box, and boxes and holders for burgers, boxes and holders for French fries, boxes and holders for hot dogs, and boxes and holders for sausages, boxes and holders for burritos, boxes and holders for tacos, and boxes and holders for gyros, boxes in the shape of milk cartons, drinking cups, and drink containers. Additional containers used to store oil-containing foods, and how compostability may be enhanced by a protective layer include cans holding nuts, cans holding coffee, bags holding coffee and/or nuts, soup cans, and noodle stock cans.

The container can be a cellulosed-based container, corrugated cardboard or corrugated fiberboard, or a plastic or metal container. Exemplary plastic containers include those made of polyethylene terephthalate, and #1 PET thermoform packing. Any inks used in the container are preferably water-soluble recycling-friendly inks. Suitable inks include water-based inks, UV curable inks, and flexographic inks.

In another aspect, the invention features a manufacture including a food container having a first interior face, and means for preventing contaminants on the first interior face from interfering with recycling of the food container.

Among these embodiments are those in which the means for preventing contaminants on the first interior face from interfering with recycling of the food container includes a protective layer disposed on the first interior face and affixed thereto by an adhesive interface such that the protective layer is peelable off the first interior face, and those in which the means for preventing contaminants on the first interior face from interfering with recycling of the food container includes perforations for facilitating separation of the first interior face from the food container.

In yet another aspect, the invention features a manufacture including a container. The container includes a first interior face having disposed thereon a first protective layer for protecting the first interior face from exposure to contaminants that would interfere with recycling of the container. The first protective layer is affixed to the first interior face by an adhesive interface so as to be peelable from the first interior face.

In some embodiments, the container is one used for packaging of medical products. In others, the container is one used in the transportation-packaging industry. Among these are containers used to transport hazardous materials, such as toxic chemicals and biohazards. These embodiments can include a protective hazmat layer to prevent contamination of one or more interior faces of the container.

These and other features of the invention will be apparent from the following detailed description and the accompanying figures, in which:

DESCRIPTION OF THE FIGURES

Like reference numbers in the various figures correspond to similar structures.

DETAILED DESCRIPTION

Figure 1:
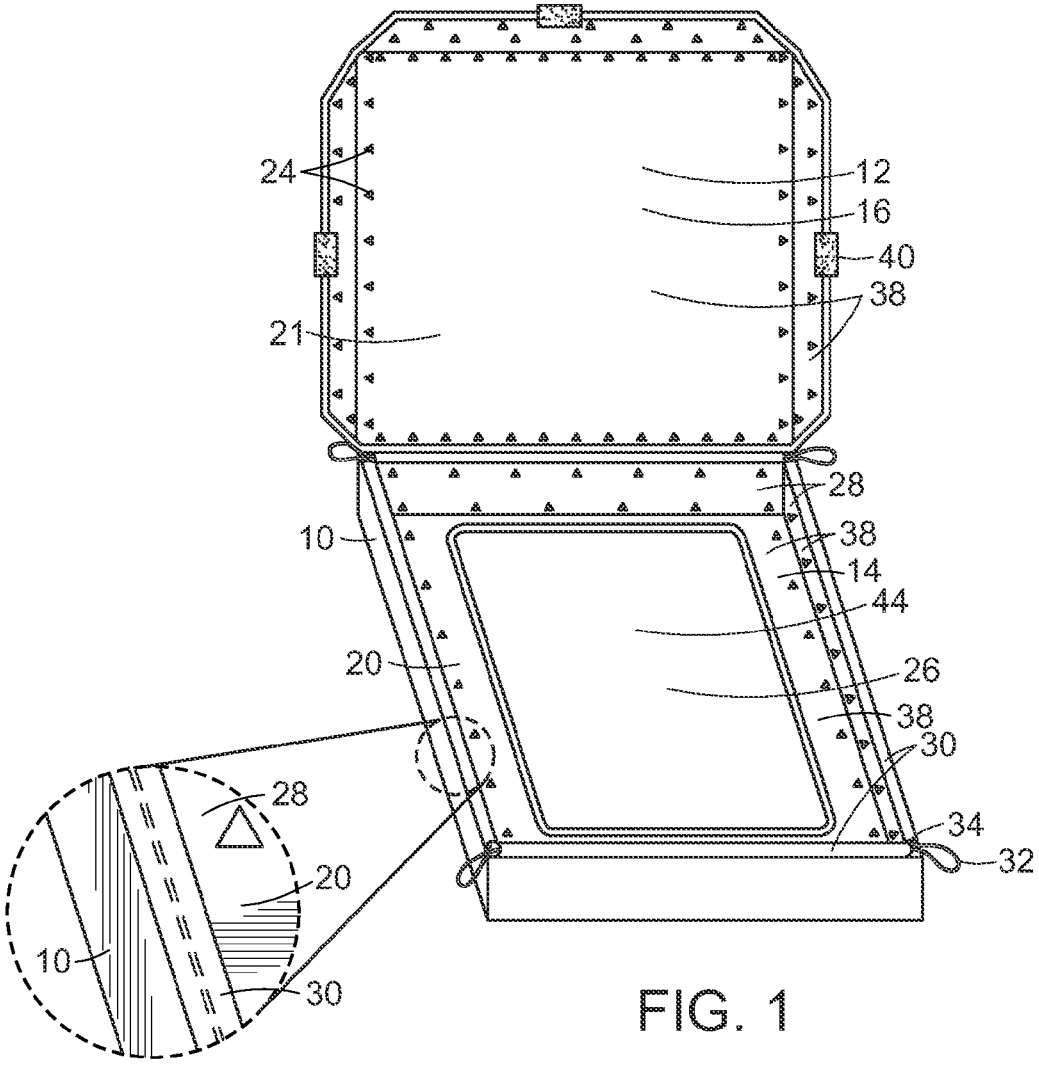
FIG. 1 is an isometric view of a food container having a protective layer.

FIG. 1 shows a food container 10 having a lid 12 and a base 14 having a lid-interior surface 16 and a base-interior surface 18 respectively. A peelable protective layer 20 adheres to the base-interior surface 18. In some cases, the food container 10 is delivered to a restaurant in collapsed form and is assembled prior to use. For these cases, the peelable protective layer 20 is incorporated into the food container 10 in a way that does not prevent collapse, and assembly of the food container 10.

The peelable double-layer 20 can have one or more lamina. In the particular embodiment shown in FIG. 2, the illustrated protective layer 20 includes a bottom lamina 22 affixed to the base-interior surface 18 by an adhesive interface 24.

Preferably, the adhesive interface 24 uses a recycling-compatible adhesive. Such adhesives are useful because unlike pressure sensitive adhesives, which do not dissolve in water and instead fragment into small particles that interfere with paper re-pulping.

The protective layer 20 also includes a top lamina 26 disposed over the bottom lamina 22, and in contact with any food placed in the food container 10. The top lamina 26 and the bottom lamina 22 are conjoined so that they can be peeled off the base-interior surface 18 as a unit.

The top lamina 26 is made of an oil and moisture absorbent material. As a result, the top lamina 26 wicks away oil. In doing so, it prevents, or at least reduces, the puddle of grease that can often be found in a food container 10. The absorbent material also absorbs condensed water vapor formed as the food stored within the food container 10 cools down. This absorbency helps maintain crispiness.

An example of an absorbent material is an edible material such as that used to absorb water in many candies.

The top lamina 26 can be made of conventional polymers or polymer particles, including those whose porosity is adjustable, and those that are edible or that would not otherwise contaminate the food. Preferably, the top lamina 26 is also abrasion resistant or resistant to cutting. This is particularly important when the food container 10 is a pizza box because pizza is typically sliced with a sharp knife directly on the container prior to serving. Examples of suitable materials include ePTFE, and shellac.

The bottom lamina 22 is made of a non-stick material to facilitate peeling the entire protective layer off the base-interior surface 18. The bottom lamina 22 is also oil resistant to ensure that oil and grease do not reach the base-interior surface 18 and thus contaminate the food container 10. Exemplary materials for use as a bottom lamina 22 include polyurethane and ePTFE.

Other materials suitable for use in the bottom lamina 22 include biodegradable plastics that have been approved by the BPI (Biodegradable Products Institute) under standards ASTM D6868, ASTM D6400, and EN 13432. These biodegradable plastics include polyhydroxyalkanoates, polyhydroxybutyrate, and lignin based biodegradable plastics.

An alternative to the use of plastic materials in the bottom lamina 22 is to use glassine paper, which is both grease proof and biodegradable in nature.

The dual-lamina peelable protective layer 20 described above is particularly useful for cellulose-based food containers that hold foods that have a tendency to become soggy. It is therefore particularly useful in pizza boxes, as well as in containers, including buckets, for French fries, popcorn, and fried foods, such as fried chicken.

The adhesive interface 24 need not cover the entire bottom lamina 22. In some embodiments, the adhesive interface 24 only covers a periphery of the bottom lamina 22. This enables the bottom lamina 22 to more easily be peeled off the bottom surface. However, in some applications, it is desirable to minimize shifting. In that case, the adhesive interface 24 may cover the entire bottom lamina 22 rather than merely its periphery.

Although most of the oil in a food container 10 settles on the base-interior surface 18, sidewalls 28 and even the lid-interior surface 16 of the food container 10 are both subject to oil contamination. Consequently, embodiments include additional protective layers on any combination of the sidewalls and the lid-interior 16, as well as the base 14.

The particular embodiment shown in FIG. 1 includes a peelable protective layer 20 disposed to protect the lid-interior 16, the base 14, and the sidewalls 28. However, in some embodiments, only some of the interior faces of the container 10 are protected by a protective layer 20.

In the case in which more than one face of the container is protected, there are two options. In a first option, each face to be protected has its own protective layer 20. A result of this configuration is that each protective layer 20 must be individually peeled off. In a second option, one protective layer spans two or more faces to be protected. A result of this configuration is that the act of peeling off the protective layer 20 is easier.

A variety of devices are available for easing the task of peeling off the protective layer 20. One relies on one or more tabs 40 and the other relies on a drawstring 32. FIG. 1 shows examples of both of these devices. In particular, a tabbed protective layer 21 that protects the lid interior surface 16 peels off using tabs 40 and a drawn protective layer 20 that protects the base interior surface 18 peels off using a drawstring 32.

As shown in FIG. 1, an optional tab 40 protrudes from the tabbed protective layer 21 that protects the lid interior surface 16. Once the food has been consumed, the consumer can take hold of the tab 40 and peel the tabbed protective layer 21 off whatever face or faces the protective layer 20 is protecting, which in the embodiment shown is the interior surface 16 of the lid 12. The remnants of the food, and in particular the oil and other food contaminants, remain with the tabbed protective layer 21 and can easily be discarded to biodegrade as regular trash, or recycled separately to extract oil for alternative fuels. As a result, the face that is being protected remains free of any contaminants, and can be recycled.

Figure 3:
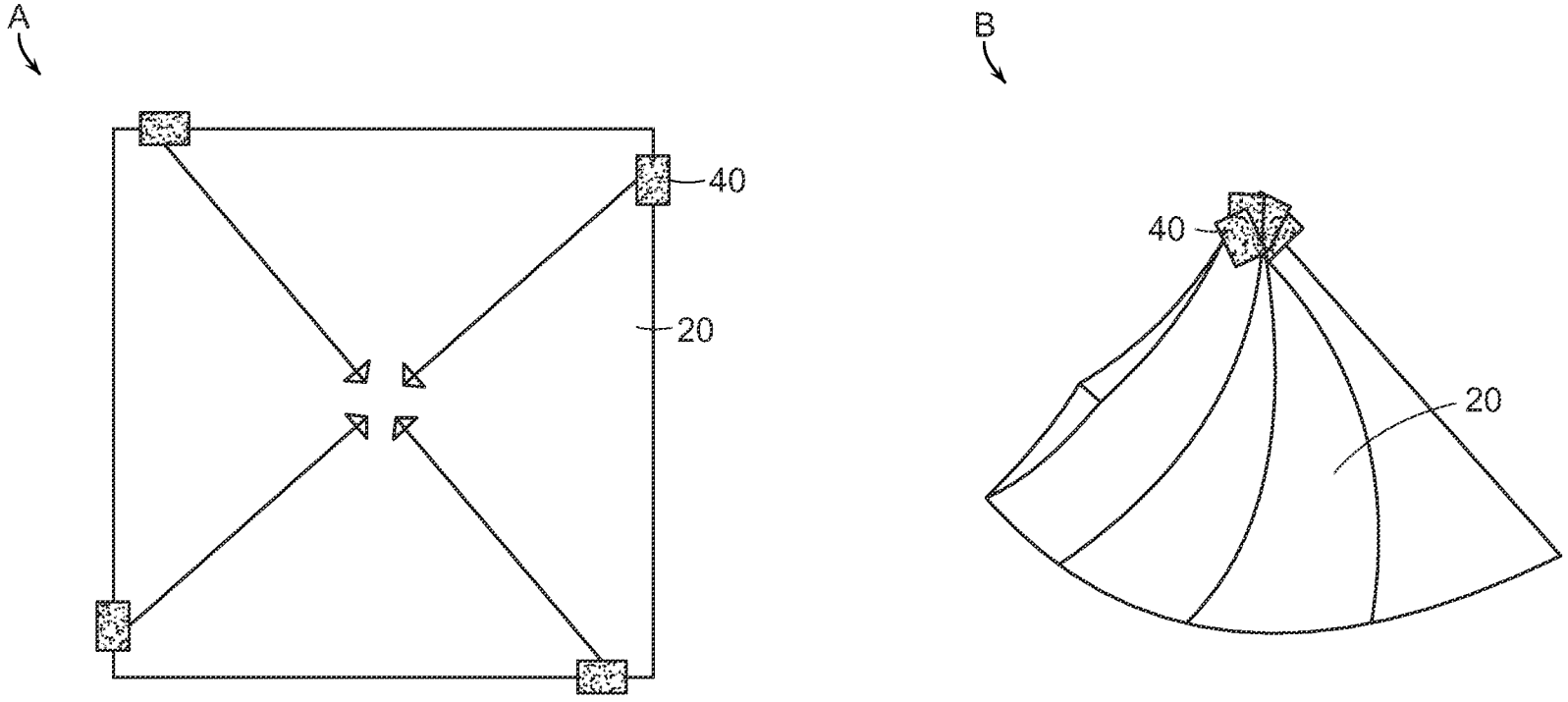
FIG. 3 shows the tabbed protective sheet of FIG. 1 being folded for discard.

In one embodiment, shown in the left-hand side of FIG. 3, the tabs 40 are arranged on corners of the protective layer 20. Once peeled off, the protective layer 20 is folded by bringing the tabs 40 together to form the enclosed conical structure shown in the right-hand side of FIG. 3. Preferably, the four tabs 40 are configured to either stick together, to snap together, or to be fastened together so that the enclosed conical structure can conveniently be discarded.

Figure 4:
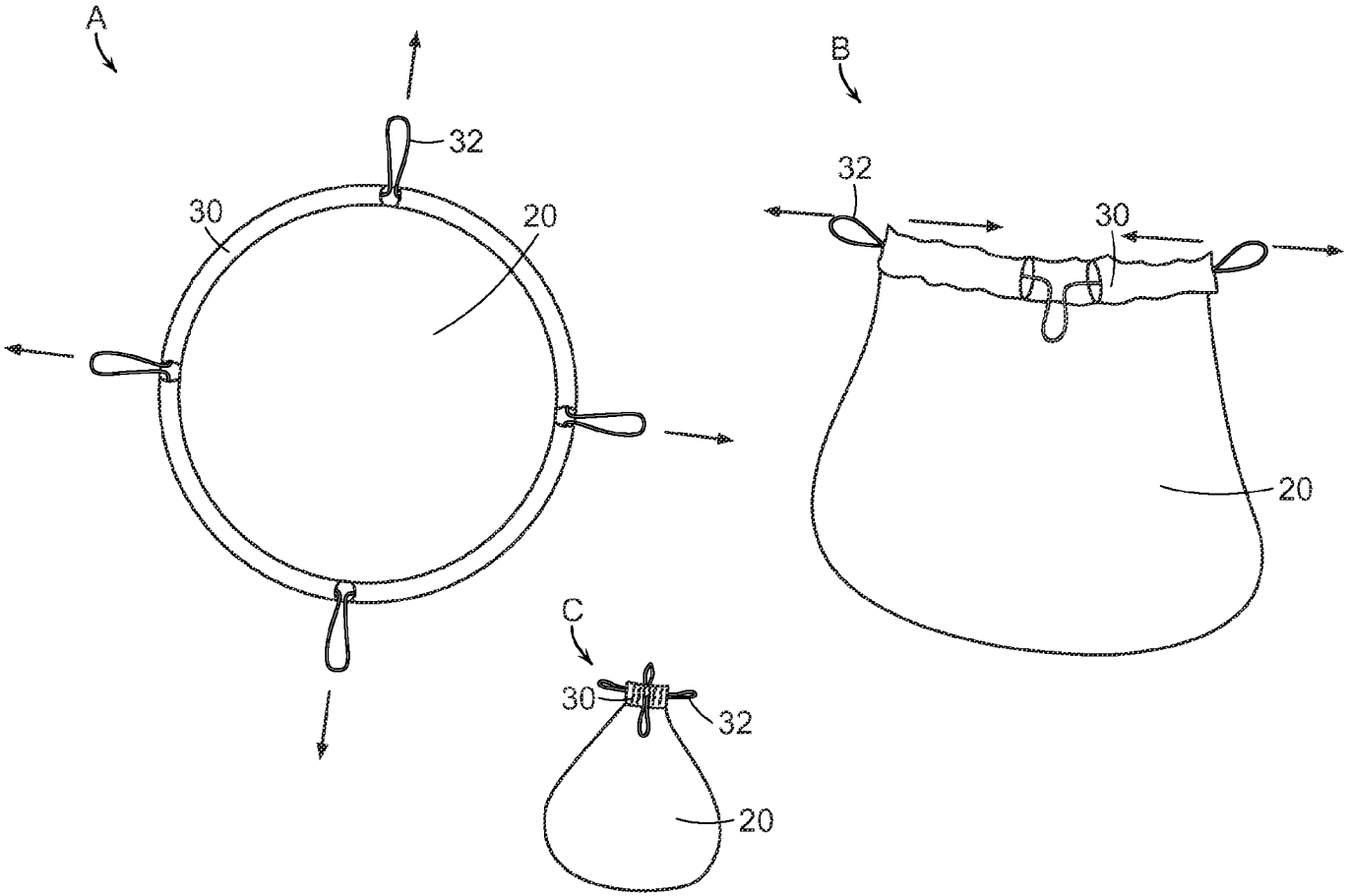
FIG. 4 shows the drawstring of FIG. 1 after having been drawn to form a sack.

The embodiment shown in FIG. 1 also features a drawn protective layer 20 for the base interior surface 18. This drawn protective layer 20 includes a channel 30 at a periphery thereof and a drawstring 32 passing through the channel 30 and having one or more protruding ends 34. In this embodiment, the consumer, upon finishing, the food, simply pulls on one or more of the protruding ends 34, thus applying a shear force to peel the drawn protective layer 20 and to simultaneously form a sack 36 as shown in FIG. 4. This particular implementation reduces the likelihood of spillage of food remnants onto the food container 10. In some embodiments, the sack 36 is either compostable or recyclable.

In some cases, it may be inconvenient to handle the protruding ends 34. For example, if the protruding ends 34 have food residue on them, one may not wish to handle them. To address this difficulty, an alternative embodiment of the channel 30, shown in FIG. 5, features partial cutaways through which the drawstring 32 can be accessed. This provides additional locations for accessing the drawstring 32.

Figure 5:
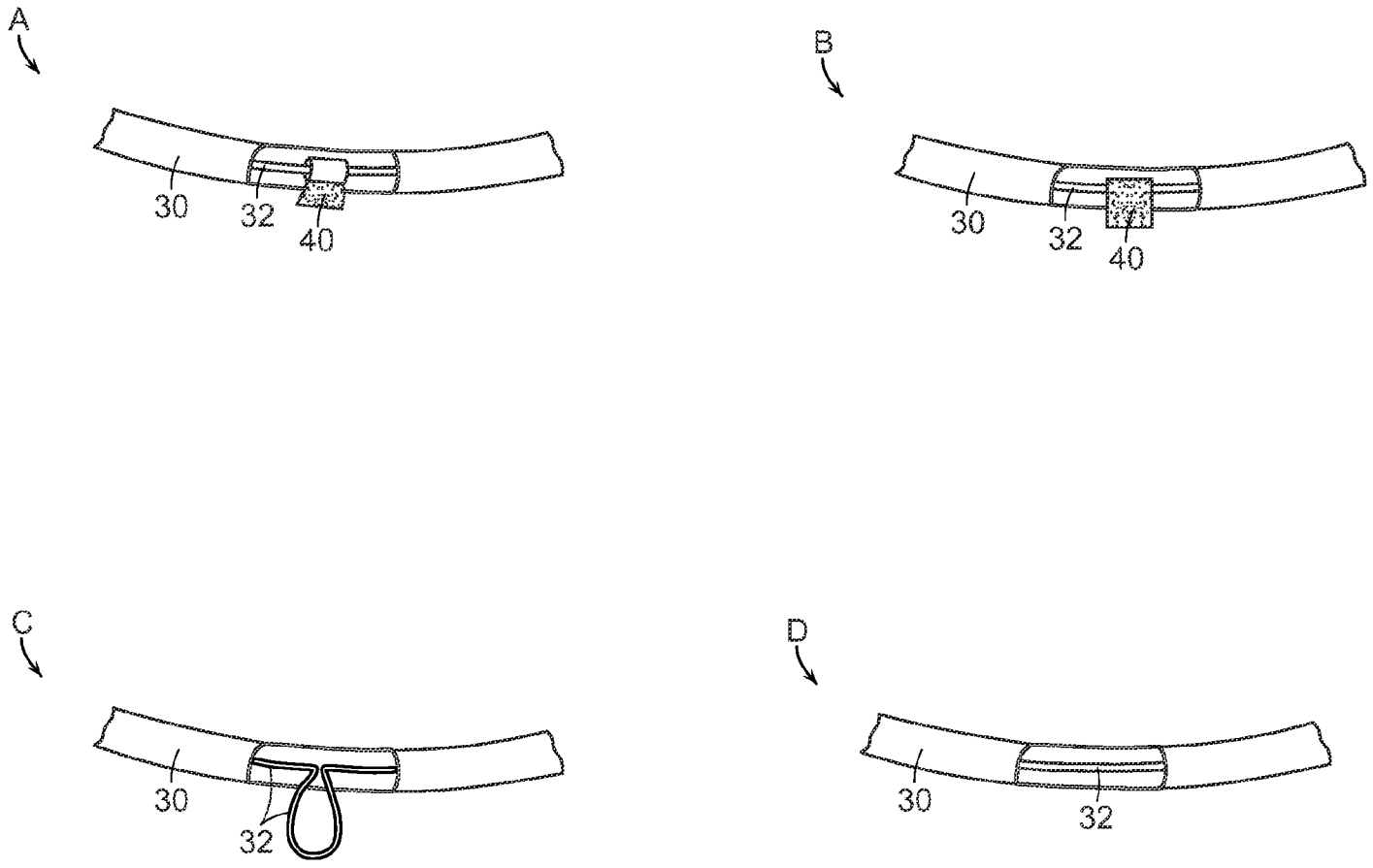
FIG. 5 shows embodiments of a drawstring and channel.

Embodiment D in FIG. 5 shows a configuration in which one reaches directly for the drawstring 32. The remaining embodiments show configurations that have a handle attached to the drawstring 32. In embodiment C, the handle is a knot or loop in the drawstring 32. In embodiment B, the handle is a tab 40 attached to the drawstring 32 so that there is no relative motion between the tab 40 and the drawstring 31. In embodiment A, the handle is also a tab 40, but looped around the drawstring 32 so that it is free to move relative the drawstring 32.

Referring back to FIG. 1, in use, a consumer would typically peel off the tabbed protective layer 21 and place it on top of the drawn protective layer 20 so that when the consumer pulls on the drawstring 32 and the bottom protective layer 20 is drawn into a sack 36, the tabbed protective layer 21 will be inside the sack 36 and the two can be discarded as a single unit.

To facilitate the foregoing procedure, some embodiments feature a tabbed protective layer 21 joined to a drawn protective layer 20 along a folding-line. In these embodiments, the consumer pulls on a tab 40 located on a side opposite the folding, line and peels the tabbed protective layer 21 back towards the folding line. The tabbed protective layer 21 can then easily be folded into the drawn protective layer 20. As a result, the tabbed protective layer 21 will be inside the sack, and the two can be discarded as a single unit.

The food container 10 can be a box, a carton, a coffee cup, a bowl, a plate, a drinking cup, bucket, oyster pail, or the like. In either case, the peelable sack 36 can capture and hold food remnants, thus protecting the container 10 from contamination.

Figure 6:
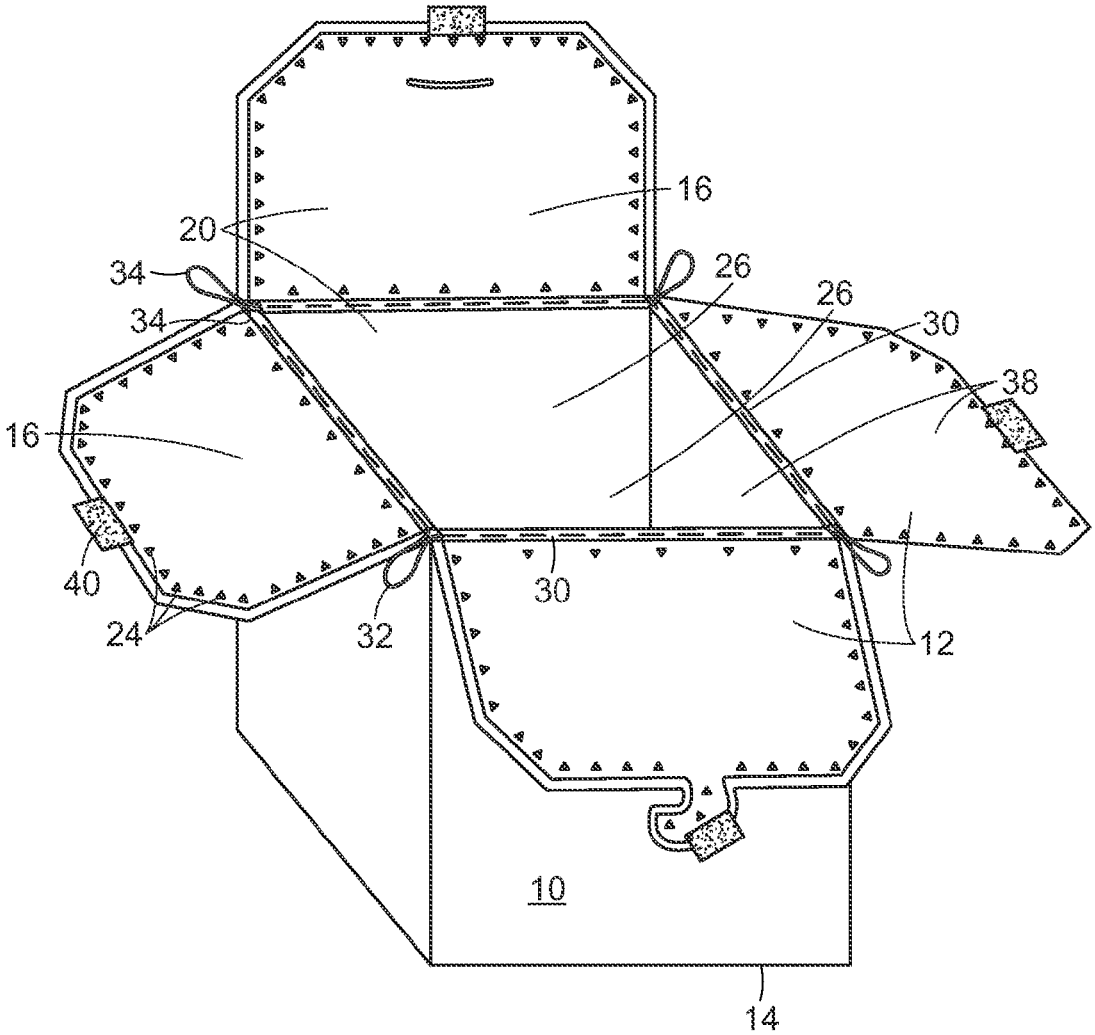
FIG. 6 shows an oyster pail with peelable protective layers.

For example, FIG. 6 shows an oyster pail, or Chinese take-out container, that features protective layers 20 on each interior face. In this embodiment, one protective layer, which incorporates a drawstring 32, protects the bottom and sidewalls. Additional protective layers, which incorporate tabs 40, protect the interior faces 16 of the lid 12. This configuration is well suited for an oyster pail because the often saucy contents that are typical in such containers are more readily contained in a sack 36, whereas the faces of the lid tend not to sustain such contamination. Moreover, the depth of the container and the narrowness of its opening would make it difficult to peel off the protective layer 20 using tabs 40.

Figure 7:
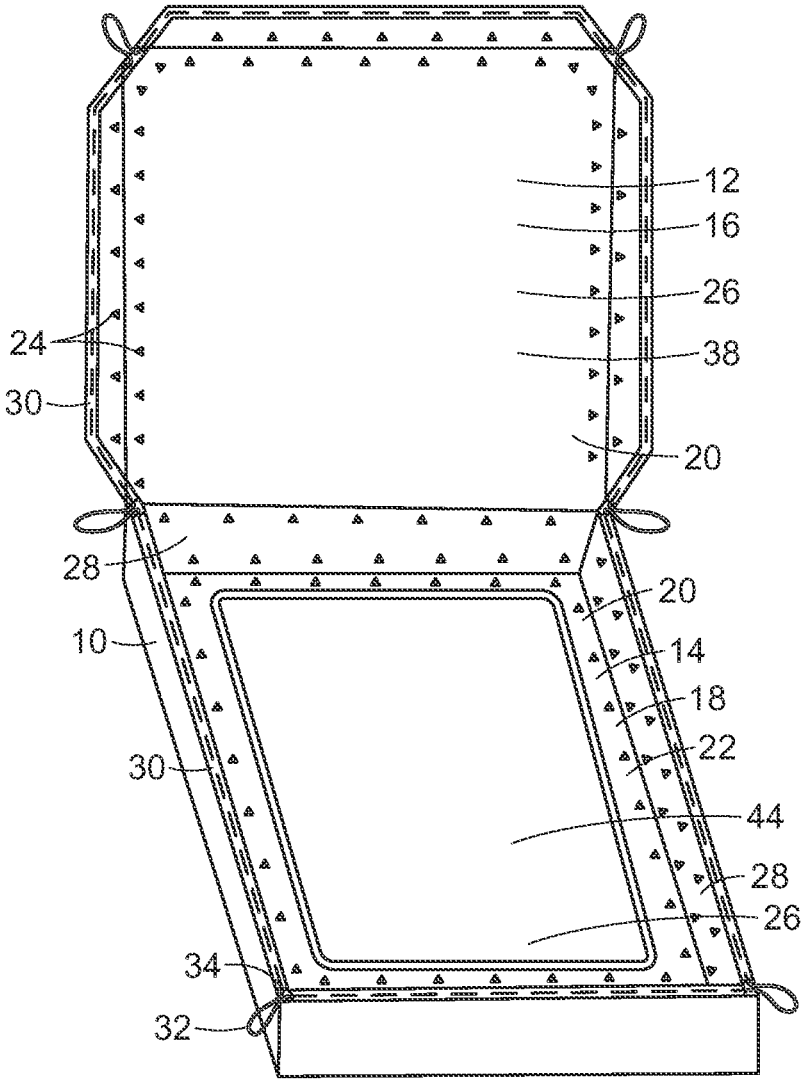
FIG. 7 shows a food container in which the protective layers are both peeled of using drawstrings.
Figure 8:
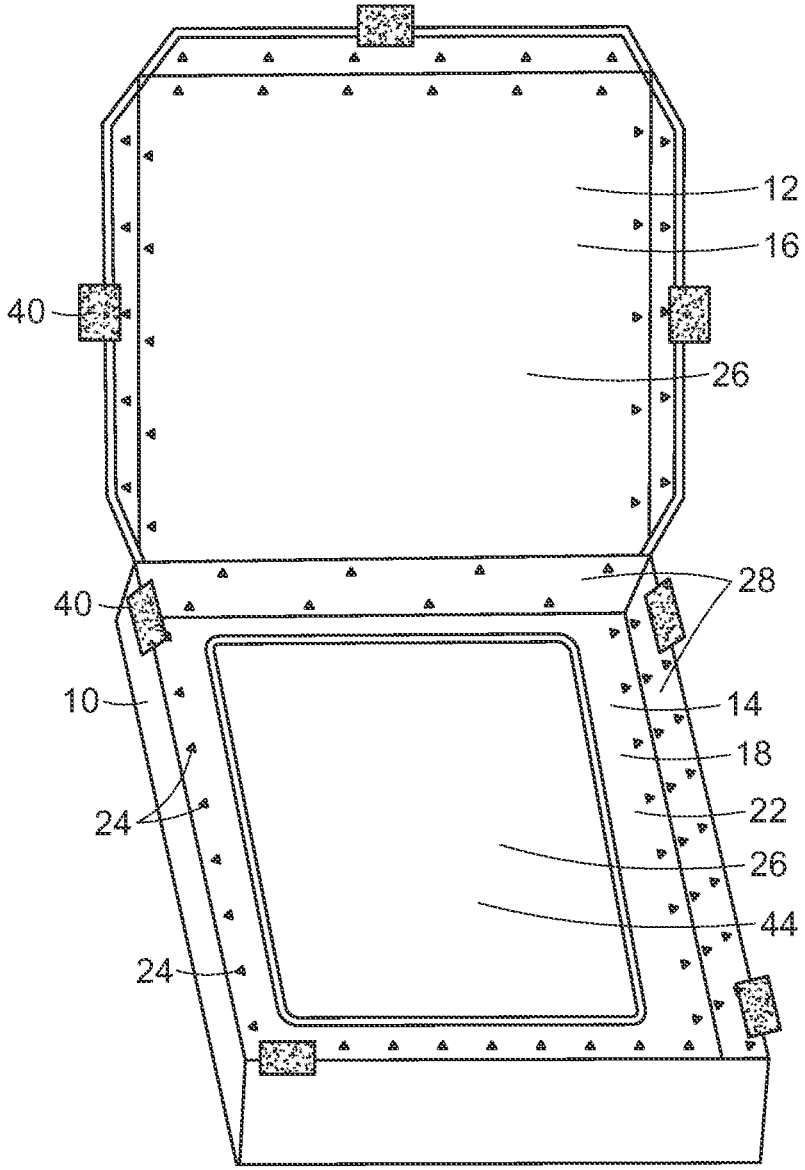
FIG. 8 shows a food container in which the protective layers are both peeled of using tabs.

FIG. 7 shows another embodiment in which a container 10 features two protective layers 20, each configured to be peeled off using drawstrings 32. A similar container 10, in which the two protective layers 20 are configured to be peeled off using tabs 40 instead of drawstrings, is shown in FIG. 8.

Figure 9:
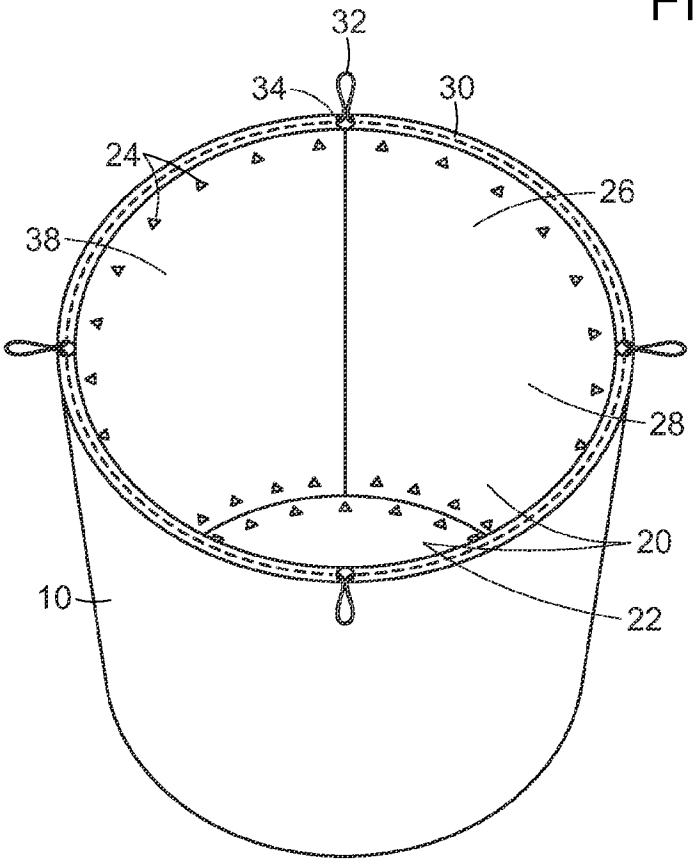
FIG. 9 shows a food container in the form of a bucket equipped with protective layers.

Another embodiment, shown in FIG. 9, uses the principles illustrated in connection with the oyster pail embodiment shown in FIG. 6. The container 10 shown in FIG. 9 is in the form of a bucket having a lid 12. The protective layer in the bucket is peeled of using a drawstring 32, and the protective layer on the lid is peeled off using a tab 40. The protective layer from the lid, having been peeled off, is then inserted into the resulting sack formed by the protective layer in the bucket, and discarded as a unit.

Figure 10:
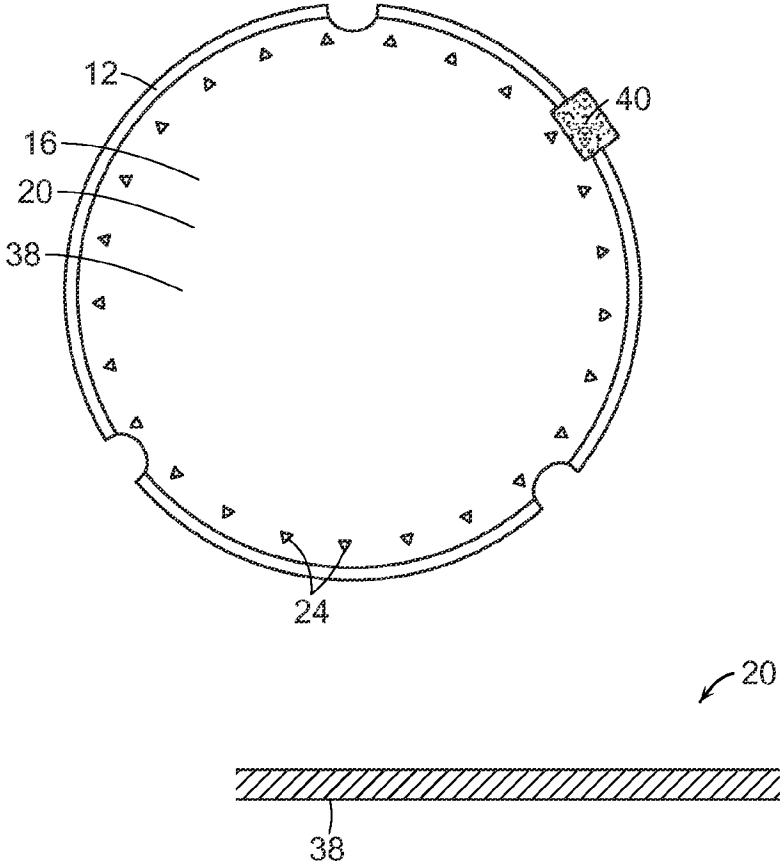
FIG. 10 shows a single lamina protective layer for the food container shown in FIG. 1.

Another implementation of a protective layer 20, shown in FIG. 10, features a single lamina 38 bonded to the base-interior surface 18 for retaining heat and protecting the base-interior surface 18 from contaminants. The single lamina 38 is thus both heat-retaining and oil resistant. A suitable material for the single lamina 38 is polyester or a similar polymer, for example a biaxially oriented polyester film with an amorphous heat-sealing layer. Also suitable for use in the single lamina 38 are biodegradable plastics such polyhydroxyalkanoates (PHAs) and polyhydroxybutyrates.

Also suitable for use as a protective layer 20 are plastic or paper films as mentioned above that are coated with a coating layer. The coating, layer can include a thin layer of metal, such as aluminum, or a thin layer of one or more oxides, such as silicon dioxide, or a metal-oxide, such as aluminum oxide, or a combination of metal and oxides. In these cases, the combination of the base layer and the metal and/or oxide coatings are such that the resulting protective layer 20 will be impermeable to diffusion of fat or other large organic molecules that interfere with the recycling process. Such coating layers are also permeable to small molecules, such as water molecules, and can therefore be used to pass steam and to thus prevent a crispy baked or fried item from becoming soggy. The permeability of the resulting protective layer 20 can be adjusted by adjusting the thickness of its coating layer.

Preferably, the single lamina 38 is one that can be both heated in the oven and refrigerated or frozen, thus rendering it useful for packaging frozen foods and foods that are to ultimately be re-heated or cooked.

The protective layer 20 with a single lamina 38 is used in the same way as the dual lamina embodiment. It too can include both tabs 26 and/or a drawstring 32 to facilitate peeling the layer of the food container 10.

The single-lamina embodiment is particularly useful for lining a food container 10 that is intended to carry foods with low grease content, such as grilled foods, or foods with high water content or saucy foods, such as Chinese stir-fry, pasta, steamed foods, soups, and sauces.

Figure 2:
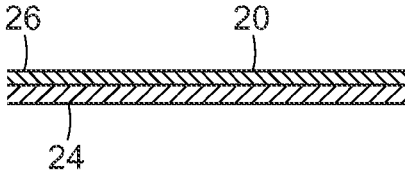
FIG. 2 is a cross-section of a dual lamina protective layer for the food container shown in FIG. 1.

Yet another embodiment includes dual lamina as described in connection with FIGS. 1 and 2, but with one of the lamina being aluminum foil and/or a polyester film. Such an embodiment provides both protection from oil contamination and heat-retention.

Protective layers as described herein can be used in pizza boxes, burger boxes, Chinese take-out food containers, and high-end restaurant take-out boxes or "doggie bags." In addition, protective layers can be used in connection with cups, soup bowls, serving bowls and plates.

Figure 11:
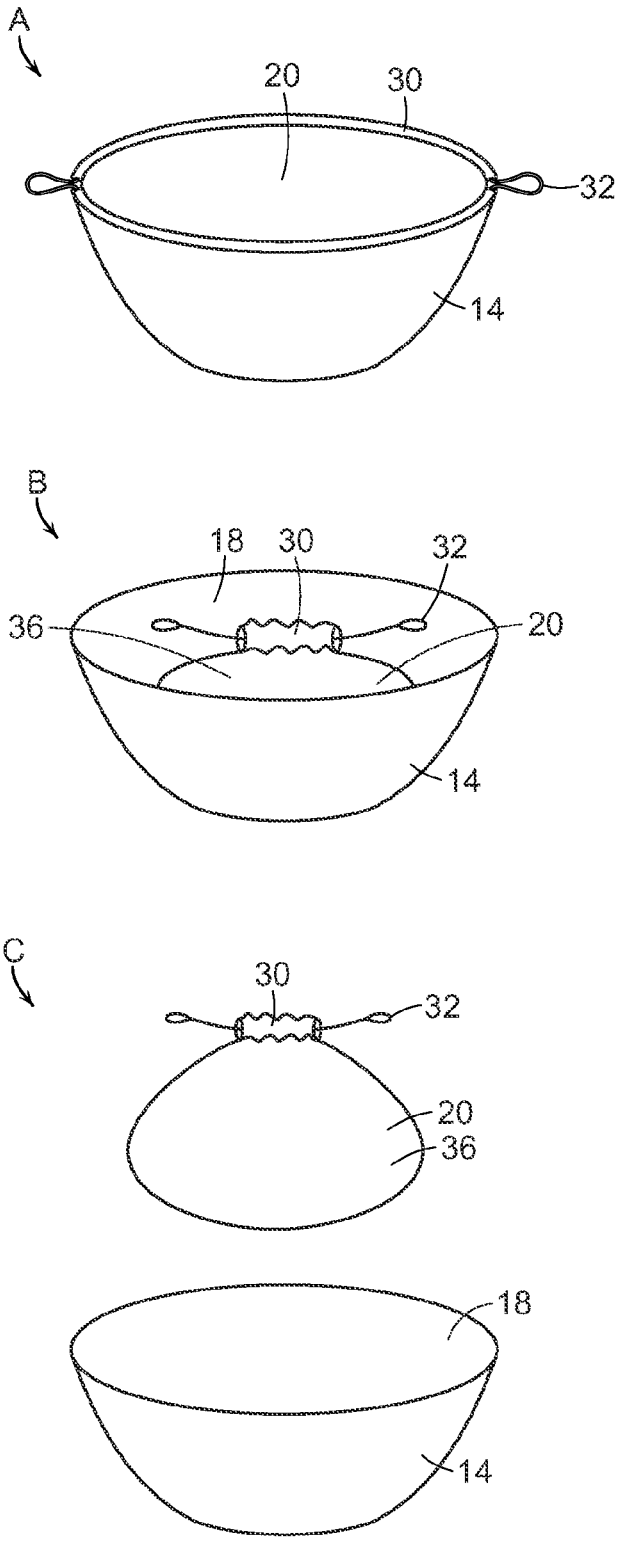
FIGS. 11 and 12 show a protective layer in use on as bowl and plate respectively.

FIG. 11 shows three stages in the use of a protective layer 20 installed in a bowl to protect a base 14 thereof as shown in step "A." As shown, the bowl is circular. However, other shapes, such as an oval can be used.

After consuming the food, the consumer pulls the drawstring 32 through the channel 30, thus causing the protective layer 20 to peel of the base 14 and form a sack 36. Then, the consumer pulls the sack 36 out of the howl for discard in the trash. The bowl itself, having been protected by the protective layer 20, remains clean enough for recycling.

In some embodiments, a bowl can be protected by a tabbed protective layer, as described below in connection with FIG. 12. In such embodiments, the bowl may have a protrusion to accommodate the tab.

Figure 12:
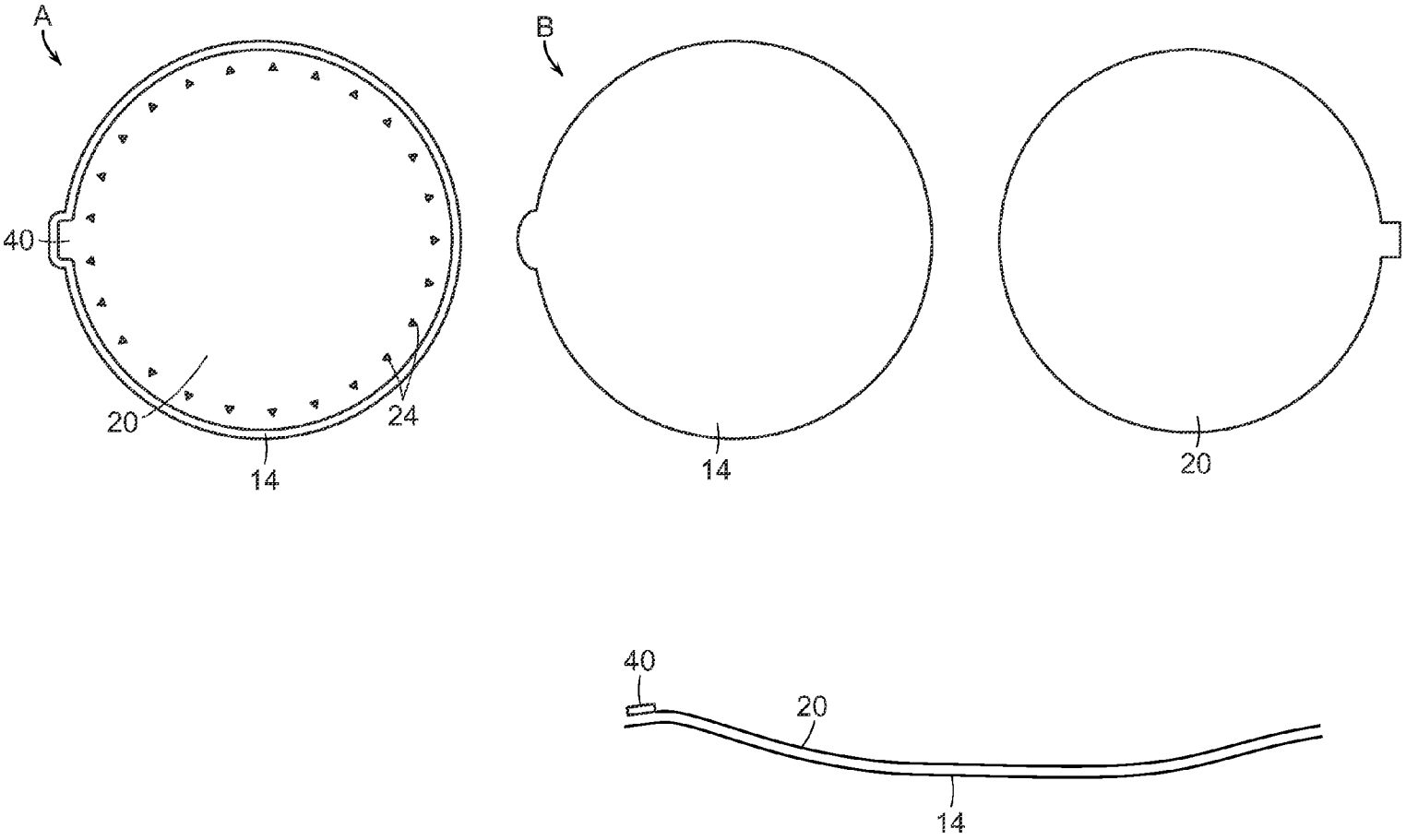

FIG. 12 shows stages in the use of a protective layer 20 to protect a base portion 14 of a plate. The illustrated plate is circular. However, other shapes can also be used.

The plate, shown in plan view and side view in the figure, has a base 20 on which a protective layer 20 has been affixed with an adhesive interface 24. As shown in the plan view of step "A." The plate is shaped with an optional protrusion on which rests a tab 40 attached to the protective layer. However, a drawstring can also be used, in which case no such protrusion would be present.

Once the consumer has consumed the food on the plate, he pulls on the tab 40, which then causes the protective layer 20 to peel off. Step "B" shows the result: a clean plate ready for recycling, and a used protective layer 20 that can conveniently be discarded.

Applications outside the food industry are also possible. For example, a waterproof protective layer 20 can be used in the medical packaging industry and/or in the transportation-packaging industry.

When used in the transportation-packaging industry, the protective layer 20 and the manner in which it is installed complies with the requirements of the "Standard Guide for Transportation Packaging Design" ASTM-D 6198-07 and related ASTM standards. In the latter case, a useful application involves the use of hazmat liners in packaging of hazardous materials that are to be transported.

Figure 13:
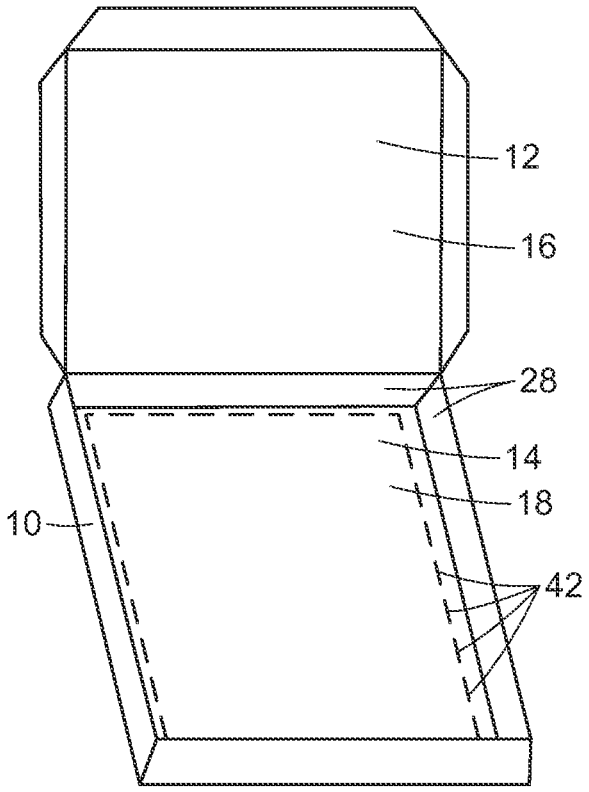
FIG. 13 shows a food container with a perforated base.

Another configuration that can be used for promoting recyclability features a food container 10, as shown in FIG. 13.

The illustrated food container 10 includes a lid 12 and a base 14 having a lid-interior surface 16 and a base-interior surface 18. However, instead of having a protective layer disposed thereon, the base 14 has perforations 42, and is therefore easily detachable from the remainder of the food container 10. In this embodiment, after consumption of food contained in the food container 10, the base 14, which would contain the food remnants, is torn off and discarded separately.

Having described the invention, and a preferred embodiment thereof, what we claim as new and secured by Letters Patent is:

1. A manufacture comprising a food-container, said food-container comprising a recyclable box having a base, walls, and a lid that collectively define an enclosed space in which the food is contained, wherein said base comprises a first interior face having disposed thereon a first protective layer for protecting said first interior face from exposure to contaminants that would interfere with recycling of said food-container, said first protective layer being affixed to said first interior face by an adhesive interface so as to be peelable from said first interior face, wherein said protective layer comprises a lamina that has a first side exposed to contaminants and a second side for adhering to said food-container, wherein said food container is selected from the group consisting a pizza box, an oyster pail, and a bucket with a lid, wherein said first protective layer comprises an oil-absorbent lamina and a non-stick lamina conjoined to said oil-absorbent lamina, wherein said oil-absorbent lamina is disposed to be exposed to food in said food-container and said non-stick lamina is disposed to contact said adhesive interface.

2. The manufacture of claim 1, wherein said adhesive interface comprises a recycling-compatible adhesive.

3. The manufacture of claim 1, wherein said adhesive interface comprises a water-soluble adhesive.

4. The manufacture of claim 1, wherein said adhesive interface comprises a material selected to avoid interfering with re-pulping said food-container.

5. The manufacture of claim 1, wherein said adhesive interface is disposed along a periphery of said first face and wherein an interior area of said first face, which is bounded by said periphery, is free of adhesive.

6. The manufacture of claim 1, wherein said adhesive interface is disposed to cover said first face, thereby preventing slippage of said protective layer relative to said first face.

7. The manufacture of claim 1, wherein said non-stick lamina comprises glassine paper.

8. The manufacture of claim 1, wherein said non-stick lamina comprises biodegradable plastic.

9. The manufacture of claim 1, wherein said non-stick lamina comprises a lignin-based biodegradable plastic.

10. The manufacture of claim 1, wherein said non-stick lamina comprises a material selected from the group consisting of polyhydroxyalkanoate and polyhydroxybuterate.

11. The manufacture of claim 1, wherein said non-stick lamina comprises polyurethane.

12. The manufacture of claim 1, wherein said first protective layer comprises an oxide coating.

13. The manufacture of claim 12, wherein said oxide coating comprises silicon-dioxide.

14. The manufacture of claim 12, wherein said oxide coating comprises a metal oxide.

15. The manufacture of claim 14, wherein said oxide coating comprises aluminum oxide.

16. The manufacture of claim 1, wherein said first protective layer comprises a metal coating.

17. The manufacture of claim 1, further comprising a tab affixed to said first protective layer for enabling application of a force to peel said first protective layer off said first interior face.

18. The manufacture of claim 1, further comprising a channel formed in a periphery of said first protective layer, and a drawstring passing through said channel, said drawstring having a portion that, when pulled, peels said protective layer off said first interior face and forms said protective layer into a sack.

19. The manufacture of claim 18, wherein said channel formed in said periphery through which said drawstring passes comprises a plurality of cutaways through which said drawstring is accessible.

20. The manufacture of claim 19, further comprising a tab attached to an accessible section of drawstring.

21. The manufacture of claim 19, wherein said tab is fixed to said accessible section of said drawstring.

22. The manufacture of claim 20, wherein said tab is moveable relative to said accessible section of said drawstring.

23. The manufacture of claim 20, further comprising a loop coupled to an accessible section of said drawstring.

24. The manufacture of claim 1, further comprising means for enabling application of a force for peeling said first protective layer off said first interior face.

25. The manufacture of claim 1, wherein said food-container comprises a second interior face, said second interior face having a second protective layer disposed thereon for protecting said second interior face from exposure to contaminants that would interfere with recycling of said food-container, said second protective layer being affixed to said second interior face by an adhesive interface so as to be peelable from said second interior face.

26. The manufacture of claim 1, wherein said food-container comprises a second interior face, and wherein said first protective layer spans said first interior face and said second interior face.

27. The manufacture of claim 1, wherein said food-container is a pizza box.

28. The manufacture of claim 1, wherein said food-container is a bucket.

29. The manufacture of claim 1, wherein said food-container is an oyster pail.

30. The manufacture of claim 1, wherein said food-container comprises plastic.

31. The manufacture of claim 1, wherein said food-container comprises a cellulose-based material.

32. The manufacture of claim 1, wherein said food-container comprises metal.

33. The manufacture of claim 1, wherein said food-container comprises corrugated cardboard.

34. The manufacture of claim 1, wherein said food-container is a corrugated fiber box.

35. The manufacture of claim 27, further comprising pizza in said pizza box.

* * * * *